United States Patent [19]

Ueda

[11] Patent Number: 4,642,280

[45] Date of Patent: Feb. 10, 1987

[54] ELECTROPHOTOGRAPHIC PHOTORECEPTORS CONTAINING HYDRAZONE COMPOUNDS AS CHARGE-TRANSFER AGENTS

[75] Inventor: Hideaki Ueda, Kawanishi, Japan

[73] Assignee: Minolta Camera Kabushiki Kaisha, Osaka, Japan

[21] Appl. No.: 738,999

[22] Filed: May 29, 1985

[30] Foreign Application Priority Data

May 31, 1984 [JP] Japan ..... 59-112568

[51] Int. Cl.[4] ..... G03G 5/06

[52] U.S. Cl. ..... 430/73; 430/83

[58] Field of Search ..... 430/59, 83, 73

[56] References Cited

U.S. PATENT DOCUMENTS 4,362,798 12/1982 Anderson et al. ..... 430/83

4,423,129 12/1983 Takasu ..... 430/59

*Primary Examiner*—John L. Goodrow

*Attorney, Agent, or Firm*—Watson, Cole, Grindle & Watson

[57] ABSTRACT

A hydrazone compound useful in phthalocyanine photoreceptors to provide them with excellent sensitivity and repeat stability and low residual voltage invention has the following formula:

[I]

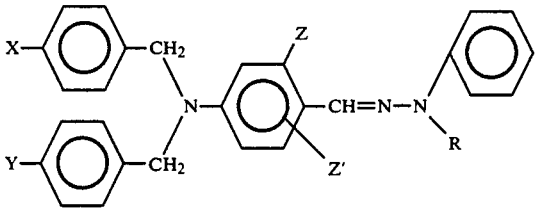

wherein X and Y independently represent a hydrogen atom, a lower alkyl, methoxy or ethoxy group, Z represents a lower alkyl, benzyl, hydroxyl, lower alkoxy, phenoxy or benzyloxy group, Z' represents a hydrogen atom, an alkyl group or an alkoxy group, and R represents a lower alkyl group, an aryl group which may have a substituent, or a benzyl group.

7 Claims, No Drawings

ELECTROPHOTOGRAPHIC PHOTORECEPTORS CONTAINING HYDRAZONE COMPOUNDS AS CHARGE-TRANSFER AGENTS

BACKGROUND OF THE INVENTION

In recent years, photoreceptors which include organic photoconductive materials, particularly phthalocyanine type photoconductive materials, have been proposed. Such photoreceptors do not cause sanitary problems, as do photoreceptors which contain selenium, cadmium sulfide, etc., and they are highly sensitive towards rays of long wavelength such as are produced by semiconductor lasers. But photoreceptors containing a phthalocyanine photoconductive powder dispersed in a binder resin have many traps so that they show the so-called induction effect, which is a phenomenon in which there is a time lag between exposure to rays and attenuation of electric potential.

In order to reduce this induction effect and thus improve the sensitivity of the photoreceptors, it is known to incorporate a charge-transfer agent in the photosensitive layer, particularly various kinds of hydrazone compounds. For example, Japanese Patent Application Kokai (Laid-open) No. 150128/1979 discloses photoreceptors for electrophotography containing hydrazone compounds having a heterocyclic ring. Japanese Patent Application Kokai No. 42380/1980 gives many examples of hydrazone compounds represented by a general formula. Japanese Patent Application Kokai No. 46760/1980 discloses the application of hydrazone compounds having a carbazole ring to photoreceptors for electrophotography. Japanese Patent Application Kokai No. 52063/1980 discloses hydrazone compounds having a condensed polycyclic or heterocyclic group. Further, Japanese Patent Application Kokai No. 52064/1980 discloses a technique which uses hydrazone compounds having a dibenzylaminophenyl group as a charge-carrying substance for electrophotography, but this phenyl group has no substituent other than a dibenzylamino group.

Photoreceptors that include the hydrazone compound disclosed in the noted citations are not satisfactory in their sensitivity, their repeat stability, their residual voltage ($V_R$) and/or their electric potential ($Vi_R$) at a maximum exposure.

SUMMARY OF THE INVENTION

The present invention relates to a novel hydrazone compounds which are useful as charge-carrying substances for photoreceptors and to electrophotographic photoreceptors which contain the novel hydrazone compound as a charge-transfer agent, such photoreceptors hving excellent sensitivity, repeat stability and low residual voltage.

The present invention provides novel hydrazone compounds represented by the general formula (I);

[I]

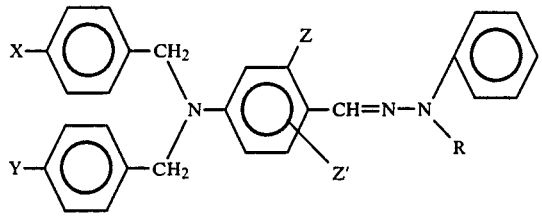

wherein X and Y independently represent a hydrogen atom or a lower alkyl, methoxy or ethoxy group, Z represents a lower alkyl, benzyl, hydroxyl, lower alkoxy, phenoxy or benzyloxy group, Z' represents a hydrogen atom or an alkyl or alkoxy group, and R represents a lower alkyl group, aryl group which may have a substituent, or benzyl group.

Further, the present invention relates to an electrophotographic photoreceptor which contains a phthalocyanine photoconductive powder and a hydrazone compound represented by the general formula (I) in the photosensitive layer, wherein X, Y, Z, Z' and R have the same meanings as described above.

In the compound of the present invention represented by the general formula (I), X and Y are preferably a hydrogen atom or a $C_1$–$C_5$ alkyl group (most preferably a methyl or ethyl group), a methoxy group or a ethoxy group; Z, which is a substituent linked to the phenyl group, is preferably a $C_1$–$C_5$ alkyl group (most preferably a methyl, ethyl group or n-propyl group), a benzyl group, a hydroxyl group, a lower alkoxy group (most preferably a methoxy, ethoxy or propoxy group), a phenoxy group or a benzyloxy group; Z' is a hydrogen atom or an alkyl or alkoxy group, particularly a hydrogen atom or a methyl, ethyl, methoxy or ethoxy group, and most especially a hydrogen atom or a methyl group; and R is preferably a methyl, ethyl or propyl group, an aryl group which may have a substituent, or benzyl group, and especially a methyl, phenyl, benzyl, methoxyphenyl group.

When X and Y are an alkyl group having more than five carbon atoms, the molecular weight becomes too large so that the compound becomes poor in both compatibility with resins and solubility in solvents.

In the compound of the present invention, the phenyl group should have a substituent Z. When the substituent is not present, both the sensitivity and repeat characteristics become poor.

When R is a phenyl or benzyl group, R may have a relatively small alkoxy group, for example a methoxy or ethoxy group. When R is a hydrogen atom or has a too large molecular weight, the sensitivity and compatibility with resins sometimes become poor.

Specific examples of a preferred hydrazone compound will be shown below:

(1)

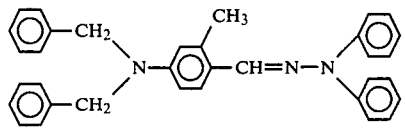

-continued (2)

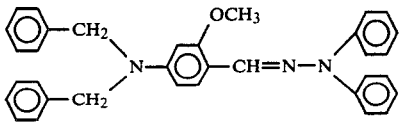

(3)

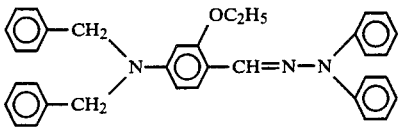

(4)

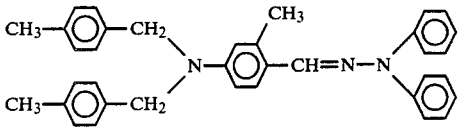

(5)

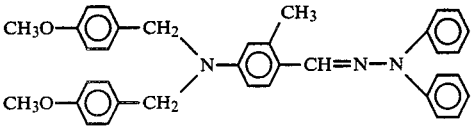

(6)

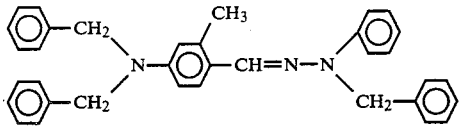

(7)

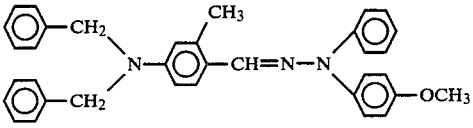

(8)

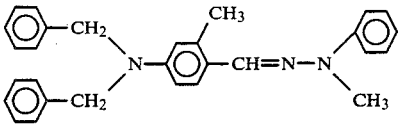

(9)

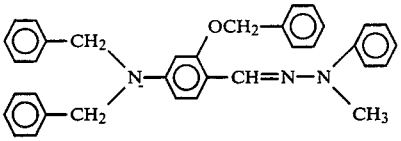

(10)

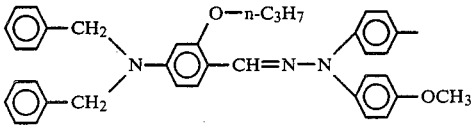

(11)

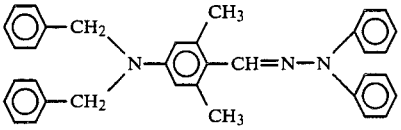

-continued (12)

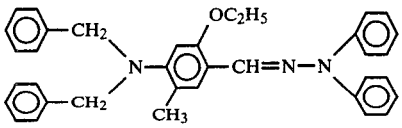

The hydrazone compound of the present invention represented by the general formula (I) can easily be produced by the well-known method.

For example, it is obtained by reacting a benzylaminobenzaldehyde represented by the general formula (II);

[II]

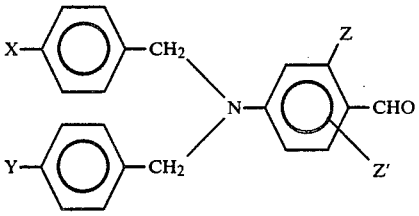

wherein X, Y, Z and Z′ have the same meanings as described above, with a hydrazine represented by the general formula (III);

[III]

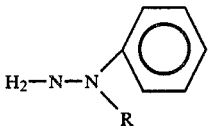

wherein R has the same meaning as described above, or its hydrochloride, in an inert organic solvent while refluxing at a temperature of 20° to 100° C. The inert organic solvent includes for example benzene, toluene, chlorobenzene, acetone, N,N-dimethylformamide, tetrahydrofuran, ethanol and the like.

The electrophotographic photoreceptor of the present invention can be produced for example as follows: A coating liquor is produced by dissolving a hydrazone compound represented by the general formula (I) and a binder in a suitable solvent, and, as the need arises, adding a phthalocyanine photoconductive material and electron attractive compound or a sensitizing dye and pigment to the solution; and then the resulting coating liquor is applied to an electroconductive substrate and dried to form a photosensitive layer of, generally, 6 μm to 30 μm in thickness.

Various forms are known for the photosensitive layer of the electrophotographic photoreceptors, and any form will do.

For example, there are photosensitive layers in which a phthalocyanine photoconductive particle and the hydrazone compound have been dispersed in a binder; photosensitive layers which are a laminate of a charge-generating layer and charge-transfer layer, the former layer comprising a phthalocyanine photoconductive particle or the particle and a binder, and the latter one comprising the hydrazone compound and a binder; and the like.

The photosensitive layer comprising two layers, one being a charge-generating layer and the other a charge-transfer layer, can be produced by forming a charge-transfer layer having the hydrazone compound dispersed in a binder on a charge-generating layer having a phthalocyanine photoconductive material dispersed in a binder.

The amount of the hydrazone compound added is 10 to 200 parts by weight, preferably 20 to 150 parts by weight, based on 100 parts by weight of a binder resin.

The photoreceptor formed in this manner may have an adhesive layer, intermediate layer and surface-protective layer as need arises.

In the present invention, when the photosensitive layer has been formed by dispersing a hydrazone compound represented by the general formula (I) and a phthalocyanine photoconductive material together in a binder, there can be obtained photoreceptors which are particularly high in sensitivity and low in residual voltage, and besides which they are superior in durability because, when they are repeatedly used, the fluctuation or surface potential, reduction of sensitivity and accumulation of residual voltage are small.

As the phthalocyanine photoconductive material used in the present invention, phthalocyanine itself and its well known derivatives may be used. Specifically, these compounds include aluminum phthalocyanine, beryllium phthalocyanine, magnesium phthalocyanine, calcium phthalocyanine, zinc phthalocyanine, gallium phthalocyanine, cadmium phthalocyanine, indium phthalocyanine, lanthanum phthalocyanine, samarium phthalocyanine, europium phthalocyanine, dysprosium phthalocyanine, yttrium phthalocyanine, ruthenium phthalocyanine, copper phthalocyanine, vanadium phthalocyanine, tin phthalocyanine, titanium phthalocyanine, lead phthalocyanine, thorium phthalocyanine, uranium phthalocyanine, manganese phthalocyanine, iron phthalocyanine, cobalt phthalocyanine, nickel phthalocyanine, rhodium phthalocyanine, palladium phthalocyanine, vanadyl phthalocyanine and the like. Also, the central nucleus of phthalocyanine is not a metal atom, but may be a halogenated metal having a trivalence or more.

Also, copper 4-aminophthalocyanine, iron polyhalophthalocyanine, cobalt hexahalophthalocyanine, metal-free phthalocyanine compounds (e.g. tetraazophthalocyanine, tetramethylphthalocyanine, dialkylaminophthalocyanine) and the like are preferred. These phthalocyanines may be used alone or in combination.

Also, there may be used phthalocyanine photoconductive material compositions obtained by mixing a phthalocyanine derivative in which the hydrogen atom of the benzene nucleus of the phthalocyanine molecule has been substituted with at least one member selected from electron attractive groups consisting of a halogen atom and a nitro, cyano, sulfonic and carboxyl, groups, and at least one non-substituted phthalocyanine compound selected from phthalocyanine and the foregoing phthalocyanine compounds with an inorganic acid capable of forming a salt with them, and depositing them with addition of water or a basic substance. In this case, the phthalocyanine derivative having any number, from 1 to 16 per molecule, of the electron attractive group as a substituent may be used. Also, the mixing ratio of the electron attractive group-substituted phthalocyanine derivative to the non-substituted phthalocyanine compound is preferably determined so that the number of the substituents of the former derivative is 0.001 to 2, preferably 0.002 to 1 permolecule of unit phthalocyanine in the composition. Examples of the inorganic acid capable of forming a salt with the phthalocyanine compound used in producing the foregoing phthalocyanine phtoconductive material composition includes for example sulfuric acid, orthophosphoric acid, chlorosulfonic acid, hydrochloric acid, hydroiodic acid, hydrofluoric acid, hydrobromic acid and the like.

Of the foregoing photoconductive materials, those which are particularly suitable to attain the object of the present invention includes for example metal-free phthalocyanine, copper phthalocyanine and its derivatives such as derivatives having a nuclear electron atractive group as substituent.

As the binder resin acting as an electric insulator in the present invention, all of the well known binders, such as thermoplastic or thermosetting resins, photohardening resins, photoconductive resins and the like, can be used.

Examples of a suitable binder resins include for example thermoplastic binders such as saturated polyester resin, polyamide resin, acrylic resin, ethylene/vinyl acetate copolymer, ion-crosslinked olefin copolymer (ionomer), styrene/butadiene block copolymer, polycarbonate, vinyl chloride/vinyl acetate copolymer, cellulose ester, polyimide, etc.; thermosetting binders such as epoxy resin, urethane resin, silicon resin, phenolic resin, melamine resin, xylene resin, alkyd resin, thermosetting acrylic resin, etc.; photo-hardening resins; photoconductive resins such as poly-N-vinylcarbazole, polyvinylpyrene, polyvinylanthracene, etc. The binder resin of the present invention is not limited to these examples.

It is desirable for these electro-insulating resins to have a volume resistivity of not less than $1\times10^{14}$ Ω.cm as their own property.

As the electro-conductive support, the foil or plate of copper, aluminum, silver, iron, nickel or the like is used in the form of sheet or drum. Also, these metals may be used in the form of thin layer on plastic film, etc., deposited by vacuum evaporation, electroless deposition, etc.

EFFECT OF THE INVENTION

The photoreceptor obtained with the present compound has high sensitivity, high repeat stability, low residual voltage ($V_R$) and low potential at white part ($Vi_R$). Particularly, the photoreceptor of the present invention has a remarkably high sensitivity and a low residual voltage as compared with photoreceptors obtained with a hydrazone having no substituent at the phenyl group (Japanese Pat. Appln. Kokai (Laid-open) No. 52064/1980).

The present invention will now be illustrated hereinafter with reference to the following examples.

SYNTHETIC EXAMPLE 1

Synthesis of the hydrazone compound (1)

A mixture of 3.15 parts by weight of p-(dibenzylamino)-o-tolualdehyde, 2.21 parts by weight of diphenylhydrazine hydrochloride and 50 ml of ethanol is heated under reflux for 1 hour. After cooling, the deposited product is collected by filtration, washed with methanol and dried to obtain 3.8 parts by weight of the hydrazone compound (1) (yield, 79%). The product is further purified by recrystallization from ethyl acetate/-methanol to obtain a pale yellow crystal having a melting point of 149° to 151° C.

The result of elementary analysis is as follows:

| | C % | H % | N % |
|---|---|---|---|
| Calculated | 84.83 | 6.44 | 8.73 |
| Found | 84.81 | 6.42 | 8.77 |

SYNTHETIC EXAMPLE 2

Synthesis of the hydrazone compound (2)

A mixture of 3.31 parts by weight of p-(dibenzylamino)-o-tolualdehyde, 2.21 parts by weight of diphenylhydrazine hydrochloride, 50 ml of ethanol and a small amount of acetic acid is heated under reflux for 1 hour. After cooling, the deposited product is collected by filtration, washed with methanol and dried to obtain 3.9 parts by weight of the hydrazone compound (2) (yield, 78.5%). The product is further purified by recrystallization from ethyl acetate/methanol to obtain a pale yellow crystal having a melting point of 143° to 145° C.

The result of elementary analysis is as follows:

| | C % | H % | N % |
|---|---|---|---|
| Calculated | 82.09 | 6.24 | 8.45 |
| Found | 82.03 | 6.25 | 8.48 |

SYNTHETIC EXAMPLE 3

Synthesis of the hydrazone compound (3)

A mixture of 3.45 parts by weight of p-(dibenzylamino)-o-ethoxyphenylaldehyde, 2.21 parts by weight of diphenylhydrazine hydrochloride and 50 ml of ethanol is heated under reflux for 1 hour. After cooling, the deposited product is collected by filtration, washed with methanol and dried to obtain 3.8 parts by weight of the hydrazone compound (3) (yield, 74%). The product is further purified by recrystallization from ethyl acetate/methanol to obtain a pale yellow crystal.

SYNTHETIC EXAMPLE 4

Synthesis of the hydrazone compound (4)

A mixture of 3.59 parts by weight of p-(di-p-methylbenzylamino)-o-tolualdehyde, 2.21 parts by weight of diphenylhydrazine hydrochloride, 50 ml of ethanol and a small amount of acetic acid is heated under reflux for 1 hour. After cooling, the deposited product is collected by filtration, washed with methanol and dried to obtain 3.3 parts by weight of the hydrazone compound (4) (yield, 65%). The product is further purified by recrystallization from ethyl acetate/methanol to obtain a pale yellow crystal.

SYNTHETIC EXAMPLE 5

Synthesis of the hydrazone compound (5)

A mixture of 3.75 parts by weight of p-(di-p-methoxybenzylamino)-o-tolualdehyde, 2.21 parts by weight of diphenylhydrazine hydrochloride and 50 ml of ethanol is heated under reflux for 1 hour. After cooling, the deposited product is collected by filtration, washed with methanol and dried to obtain 3.6 parts by weight of the hydrazone compound (5) (yield, 66%). The product is further purified by recrystallization from ethyl acetate/methanol to obtain a pale yellow crystal.

SYNTHETIC EXAMPLE 6

Synthesis of the hydrazone compound (6)

A mixture of 3.31 parts by weight of p-(di-p-benzylamino)-o-tolualdehyde, 2.35 parts by weight of phenylbenzylhydrazine hydrochloride, 50 ml of ethanol and a small amount of acetic acid is heated under reflux for 1 hour. After cooling, the deposited product is collected by filtration, washed with methanol and dried to obtain 3.8 parts by weight of the hydrazone compound (6) (yield, 77%). The product is further purified by recrystallization from ethyl acetate/methanol to obtain a pale yellow crystal.

SYNTHETIC EXAMPLE 7

Synthesis of the hydrazone compound (7)

A mixture of 3.15 parts by weight of p-(dibenzylamino)-o-tolualdehyde, 2.51 parts by weight of phenyl-p-methoxyphenylhydrazine hydrochloride and 50 ml of ethanol is heated under reflux for 1 hour. After cooling, the deposited product is collected by filtration, washed with methanol and dried to obtain 3.7 parts by weight of the hydrazone compound (7) (yield, 72%). The product is further purified by recrystallization from ethyl acetate/methanol to obtain a pale yellow crystal.

SYNTHETIC EXAMPLE 8

Synthesis of the hydrazone compound (8)

A mixture of 3.31 parts by weight of p-(dibenzylamino)-o-tolualdehyde, 1.59 parts by weight of phenylmethylhydrazine hydrochloride, 50 ml of ethanol and a small amount of acetic acid is heated under reflux for 1 hour. After cooling, the deposited product is collected by filtration, washed with methanol and dried to obtain 3.4 parts by weight of the hydrazone compound (8) (yield, 81%). The product is further purified by recrystallization from ethyl acetate/methanol to obtain a pale yellow crystal.

SYNTHETIC EXAMPLE 9

Synthesis of the hydrazone compound (9)

A mixture of 4.07 parts by weight of p-(dibenzylamino)-o-benzyloxyphenylaldehyde, 1.59 parts by weight of phenylmethylhydrazine hydrochloride and 50 ml of ethanol is heated under reflux for 1 hour. After cooling, the deposited product is collected by filtration, washed with methanol and dried to obtain 3.3 parts by weight of the hydrazone compound (9) (yield, 65%). The product is further purified by recrystallization from ethyl acetate/methanol to obtain a pale yellow crystal.

SYNTHETIC EXAMPLE 10

Synthesis of the hydrazone compound (10)

A mixture of 3.59 parts by weight of p-(dibenzylamino)-o-n-propoxyphenylaldehyde, 2.51 parts by weight of phenylmethoxyphenylhydrazine hydrochloride, 50 ml of ethanol and a small amount of acetic acid is heated under reflux for 1 hour. After cooling, the deposited product is collected by filtration, washed with methanol and dried to obtain 3.7 parts by weight of the hydrazone compound (10) (yield, 67%). The product is further purified by recrystallization from ethyl acetate/methanol to obtain a pale yellow crystal.

SYNTHETIC EXAMPLE 11

Synthesis of the hydrazone compound (11)

A mixture of 3.29 parts by weight of p-(dibenzylamino)-o-xylylaldehyde, 2.21 parts by weight of diphenylhydrazine hydrochloride and 50 ml of ethanol is heated under reflux for 1 hour. After cooling, the deposited product is collected by filtration, washed with methanol and dried to obtain 3.7 parts by weight of the hydrazone compound (9) (yield, 75%). The product is further purified by recrystallization from ethyl acetate/methanol to obtain a pale yellow crystal.

SYNTHETIC EXAMPLE 12

Synthesis of the hydrazone compound (12)

A mixture of 3.75 parts by weight of 4-(dibenzylamino)-2-ethoxy-5-methylbenzaldehyde, 2.21 parts by weight of diphenylhydrazine hydrochloride, 50 ml of ethanol and a small amount of acetic acid is heated under reflux for 1 hour. After cooling, the deposited product is collected by filtration, washed with methanol and dried to obtain 3.8 parts by weight of the hydrazone compound (12) (yield, 72%). The product is further purified by recrystallization from ethyl acetate/methanol to obtain a pale yellow crystal.

EXAMPLE 1

Fifty parts by weight of copper phthalocyanine and 0.2 parts by weight of tetranitro-copper phthalocyanine are dissolved in 500 parts by weight of 98% conc. sulfuric acid with thorough stirring. The resulting solution is poured into 3000 parts by weight of water to deposit a copper phthalocyanine/tetranitro-copper phthalocyanine photoconductive material composition. The composition is collected by filtration, washed with water and dried at 120° C. under reduced pressure.

Ten parts by weight of this composition, 22.5 parts by weight of a thermosetting acrylic resin (Acrydic A 405; produced by Dainippon Ink & Chemicals Inc.), 7.5 parts by weight of a melamine resin (Super Beckamine J 820; produced by Dainippon Ink & Chemicals Inc.), 15 parts by weight of the hydrazone compound (1) and 70 parts by weight of a methyl isobutyl ketone/cellosolve acetate (1:1) mixture are fed to a ball mill pot and kneaded for 48 hours to prepare a photoconductive paint. This paint is coated onto an aluminum substrate in a thickness of about 15 μm to prepare a photoreceptor.

EXAMPLE 2

A photoreceptor is produced in completely the same manner as in Example 1 except that the hydrazone compound (2) is used as a hydrazone compound.

EXAMPLE 3

A photoreceptor is produced in completely the same manner as in Example 1 except that the hydrazone compound (3) is used as a hydrazone compound.

EXAMPLE 4

A photoreceptor was produced in completely the same manner as in Example 1 except that the hydrazone compound (4) is used as a hydrazone compound.

EXAMPLE 5

Forty parts by weight of metal-free phthalocyanine and 1.5 parts by weight of dinitro-metal-free phthalocyanine are dissolved in 500 parts by weight of 98% conc. sulfuric acid with thorough stirring. The resulting solution is poured into 3000 parts by weight of water to deposit a phthalocyanine composition. The composition is collected by filtration, washed with water and dried at 120° C. under reduced pressure.

Fifteen parts by weight of this composition, 40 parts by weight of a polycarbonate resin (Panlite K 1300; produced by Teijin Kasei Co.), 45 parts by weight of a polyester resin (Villon 200; produced by Toyobo Co., Ltd.), 50 parts by weight of the hydrazone compound (2) and a tetrahydrofuran/toluene (9:1) mixture (solvent) are fed to a ball mill pot and kneaded for 48 hours to prepare a photoconductive paint. This paint is coated onto an aluminum substrate in a thickness of about 15 μm to prepare a photoreceptor.

EXAMPLE 6

A photoreceptor was produced in completely the same manner as in Example 1 except that the hydrazone compound (5) is used as a hydrazone compound.

EXAMPLE 7

A photoreceptor was produced in completely the same manner as in Example 1 except that the hydrazone compound (6) is used as a hydrazone compound.

EXAMPLE 8

A photoreceptor was produced in completely the same manner as in Example 1 except that the hydrazone compound (7) is used as a hydrazone compound.

EXAMPLE 9

A photoreceptor was produced in completely the same manner as in Example 1 except that the hydrazone compound (8) is used as a hydrazone compound.

EXAMPLE 10

A photoreceptor was produced in completely the same manner as in Example 1 except that the hydrazone compound (9) is used as a hydrazone compound.

EXAMPLE 11

A photoreceptor was produced in completely the same manner as in Example 1 except that the hydrazone compound (10) is used as a hydrazone compound.

EXAMPLE 12

A photoreceptor was produced in completely the same manner as in Example 1 except that the hydrazone compound (11) is used as a hydrazone compound.

EXAMPLE 13

A photoreceptor was produced in completely the same manner as in Example 1 except that the hydrazone compound (12) is used as a hydrazone compound.

COMPARATIVE EXAMPLE 1

A photoreceptor is produced in completely the same manner as in Example 1 except that the hydrazone compound (1) is not used.

COMPARATIVE EXAMPLE 2

A photoreceptor is produced in completely the same manner as in Example 1 except that the following compound is used as a hydrazone compound:

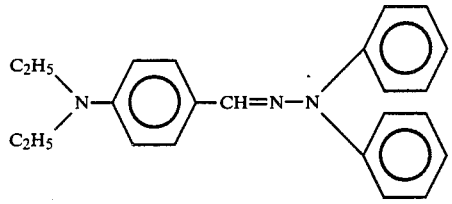

COMPARATIVE EXAMPLE 3

A photoreceptor is produced in completely the same manner as in Example 1 except that the following compound is used as a hydrazone compound:

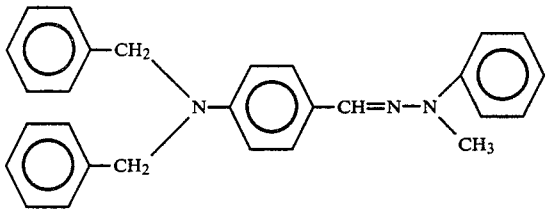

COMPARATIVE EXAMPLE 4

A photoreceptor is produced in completely the same manner as in Example 1 except that the following compound is used as a hydrazone compound:

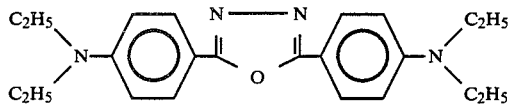

COMPARATIVE EXAMPLE 5

A photoreceptor is produced in completely the same manner as in Example 1 except that the following compound is used as a hydrazone compound:

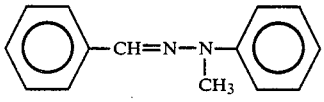

COMPARATIVE EXAMPLE 6

A photoreceptor is produced in completely the same manner as in Example 1 except that the following compound is used as a hydrazone compound:

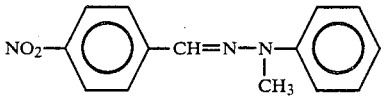

COMPARATIVE EXAMPLE 7

A photoreceptor is produced in completely the same manner as in Example 1 except that the following compound is used as a hydrazone compound:

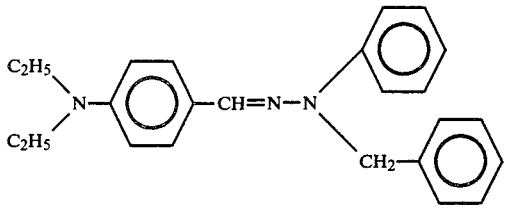

Each photoreceptor obtained above is incorporated in a commercial electrophotographic copying machine (EP-350Z; produced by Minolta Camera Co., Ltd.), and a direct current voltage of +7.0 kV is applied thereto to measure an initial surface potential ($V_0$), an exposure required for $V_0$ to lower to a half [$E_{\frac{1}{2}}$(lux.sec)] and a percent attenuation of potential [$DDR_1$(%)] when the photoreceptor is allowed to stand in the dark place for 1 second after charging.

The result is shown in Table 1.

TABLE 1

| | $V_0$ (V) | $E_{\frac{1}{2}}$ (lux · sec) | $DDR_1$ (%) |
|---|---|---|---|
| Example | | | |
| 1 | 520 | 3.2 | 20 |
| 2 | 530 | 3.5 | 18 |
| 3 | 520 | 2.8 | 20 |
| 4 | 525 | 3.0 | 19 |
| 5 | 520 | 3.1 | 15 |
| 6 | 540 | 3.0 | 16 |
| 7 | 530 | 3.2 | 18 |
| 8 | 520 | 2.8 | 19 |
| 9 | 530 | 3.3 | 18 |
| 10 | 530 | 2.8 | 19 |
| 11 | 540 | 2.7 | 15 |
| 12 | 535 | 3.2 | 16 |
| 13 | 530 | 2.8 | 18 |
| Comparative example | | | |
| 1 | 550 | 12.0 | 3 |
| 2 | 480 | 3.0 | 28 |
| 3 | 470 | 5.1 | 46 |
| 4 | 540 | 38.5 | 5 |
| 5 | 520 | 7.0 | 15 |
| 6 | 530 | 25.3 | 20 |
| 7 | 480 | 3.8 | 25 |

Using the photoreceptors obtained in Example 1 and Comparative Examples 2 and 7, the values of $V_0$ and $E_{\frac{1}{2}}$ when a cycle of charging, exposure to ray, developing and charging-off is repeated 3000 times, are measure.

The result is shown in Table 2.

TABLE 2

| | $V_0$ | $E_{\frac{1}{2}}$ |
|---|---|---|
| Example 1 | 525 | 3.4 |
| Comparative example | | |
| 2 | 560 | 7.5 |
| 7 | 520 | 8.3 |

As is apparent from the results above, the photoreceptor of the present invention has a high sensitivity and good electrostatic characteristics in terms of charge-holding ability, percent darkdecay, etc.

EXAMPLE 14

Ten parts by weight of ϵ-copper phthalocyanine (produced by Toyo Ink Mfg. Co., Ltd.), 12 parts by weight of the hydrazone compound (8), 11.1 parts by weight of acrylpolyol (Acrydic A 808; produced by Dainippon Ink & Chemicals Inc.), 7.5 parts by weight of an isocyanate compound (Desmodur N-75; produced by Nippon Polyurethane Co.), 5.8 parts by weight of an epoxy resin (Epikote 1007; produced by Shell Chemical Co.) and 50 parts by weight of a solvent are fed to a ball mill and kneaded for 48 hours to prepare a photoconductive paint. This paint is coated onto a substrate to obtain an electrophotographic photoreceptor having a photoconductive layer of about 10 μm in thickness.

COMPARATIVE EXAMPLE 8

A photoreceptor is produced in completely the same manner as in Example 14 except that the following compound is used as a hydrazone compound:

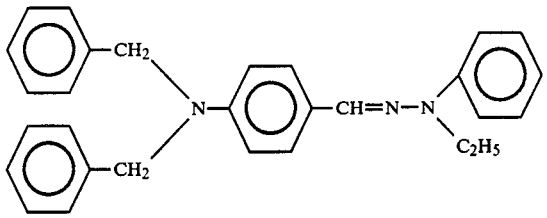

The photoreceptor obtained is incorporated in a commercial electrophotographic copying machine (EP-350Z; produced by Minolta Camera Co., Ltd.), and a direct current voltage of +7.0 kV is applied thereto to measure the electrostatic characteristics. In the table, $V_0$ is an initial surface potential (V), $DDR_1$ is a percent attenuation of potential (%) when the photoreceptor is allowed to stand in the dark place for 1 second after charging, and $E_{\frac{1}{2}}$ is an exposure (lux.sec) required for the initial surface potential to lower to a half.

The result is shown in Table 3.

TABLE 3

| | $V_0$ | $E_{\frac{1}{2}}$ | $DDR_1$ |
|---|---|---|---|
| Example 14 | 520 | 13.0 | 25 |
| Comparative example 8 | 530 | 24.5 | 40 |

EXAMPLE 15

Ten parts by weight of ε-copper phthalocyanine (produced by Toyo Ink Mfg. Co., Ltd.), 10 parts by weight of a polyester resin (Villon 200; produced by Toyobo Co., Ltd.) and 30 parts by weight of a solvent (tetrahydrofuran) are fed to a ball mill and kneaded for 48 hours to obtain a photoconductive paint. This paint is coated onto an aluminum substrate in a thickness of about 1 μm to form a charge-generating layer. Thereafter, a dispersion liquid comprising 10 parts by weight of the hydrazone compound (10), 10 parts by weight of a polycarbonate resin (Panlite K 1300; produced by Teijin Kasei Co.) and 100 parts by weight of tetrahydrofuran is produced, coated onto the above charge-generating layer, and dried at 100° C. for 10 minutes to form a charge-carrying layer of about 15 μm in thickness. A photoreceptor is thus produced.

The electrostatic characteristics of this photoreceptor are measure in the same manner as in Example 14, provided that a direct current voltate of −6.0 kV was applied to the photoreceptor because this photoreceptor has a negative chargeability (−). The result is shown in Table 4.

TABLE 4

| | $V_0$ | $E_{\frac{1}{2}}$ | $DDR_1$ |
|---|---|---|---|
| Example 15 | −550 | 12.0 | 15 |

As is apparent from Table 3 and Table 4, the photoreceptor of the present invention is superior in the electrostatic characteristics and sensitivity to those obtained in Comparative examples, and therefore it is a phthalocyanine photoreceptor exhibiting excellent characteristics on the common copying machines and laser printers.

What is claimed is:

1. An electrophotographic photoreceptor which includes a photosensitive layer that comprises a phthalocyanine photoconductive powder and a hydrazone compound represented by the general formula (I) in the photosensitive layer:

[I]

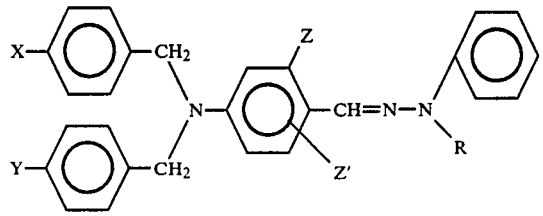

wherein X and Y independently represent a hydrogen atom or a lower alkyl, methoxy or ethoxy group, Z represents a lower alkyl, benzyl, hydroxyl, lower alkoxy, phenoxy or benzyloxy group, Z' represents a hydrogen atom or an alkyl or alkoxy group, and R represents a methyl, phenyl, benzyl or methoxyphenyl group.

2. The electrophotographic photoreceptor of claim 1, wherein hydrazone compound is:

(1)

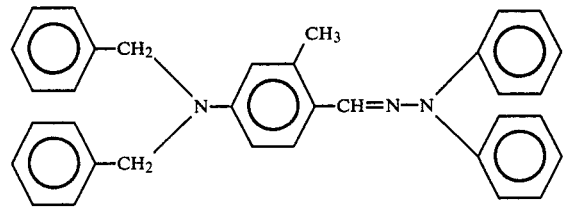

3. The electrophotographic photoreceptor of claim 1, wherein hydrazone compound is:

(2)

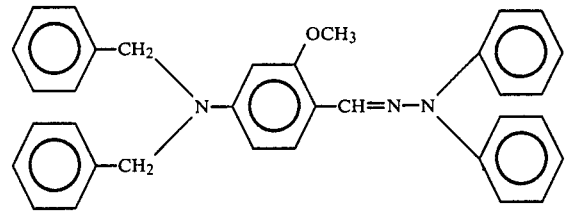

4. The electrophotographic photoreceptor of claim 1, wherein hydrazone compound is:

(3)

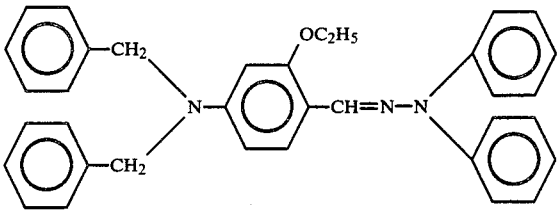

5. The electrophotographic photoreceptor of claim 1, wherein hydrazone compound is:

(5)

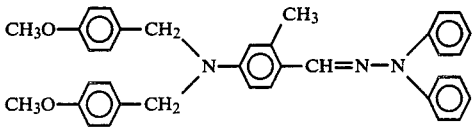

6. The electrophotographic photoreceptor of claim 1, wherein hydrazone compound is:

(10)

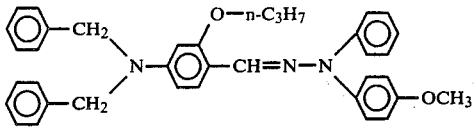

7. An electrophotographic photoreceptor which includes a photosensitive layer that comprises a phthalocyanine photoconductive powder and a hydrazone compound represented by the general formula (I) in the photosensitive layer:

[I]

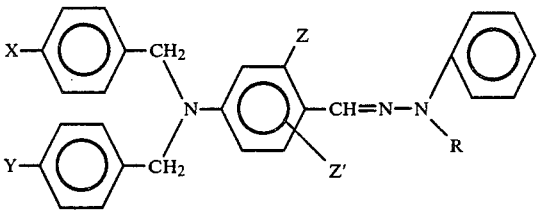

wherein X and Y independently represent a hydrogen atom or a methyl, ethyl, n-propyl or methoxy group; Z represents a methyl, methoxy, ethoxy, or benzyloxy group; Z' represents a hydrogen atom or a methyl group; and R represents a methyl, phenyl, benzyl or methoxyphenyl group.

* * * * *